US005080318A

United States Patent [19]

Takamatsu et al.

[11] Patent Number: 5,080,318

[45] Date of Patent: Jan. 14, 1992

[54] TILTING CONTROL ASSEMBLY FOR CHAIR

[75] Inventors: Shunichi Takamatsu, Osaka; Hiroji Kubo, Yahata; Katsunori Hama, Nishinomiya; Hiroshi Iwabuchi, Yahata, all of Japan

[73] Assignee: Itoki Kosakusho Co., Ltd., Osaka, Japan

[21] Appl. No.: 540,131

[22] Filed: Jun. 19, 1990

[30] Foreign Application Priority Data

Nov. 30, 1989 [JP] Japan ..... 1-139495[U]
Mar. 28, 1990 [JP] Japan ..... 2-32296[U]
Mar. 28, 1990 [JP] Japan ..... 2-79153

[51] Int. Cl.[5] ..... F16M 13/00

[52] U.S. Cl. ..... 248/598; 297/302; 297/326

[58] Field of Search ..... 248/580, 581, 582, 583, 248/585, 584, 591, 123.1, 392.1, 595, 598; 16/180; 297/301, 302, 303, 326, 327, 328

[56] References Cited

U.S. PATENT DOCUMENTS

| | | | |
|---|---|---|---|
| 391,822 | 10/1888 | Stewart | 248/596 X |
| 2,360,428 | 10/1944 | Larsen | 248/596 |
| 2,478,112 | 8/1949 | Larsen | 248/596 |
| 2,818,911 | 1/1958 | Syak | 248/596 |
| 2,956,619 | 10/1960 | Scherer | 297/328 X |
| 3,627,252 | 12/1971 | Yamaguchi | 297/328 X |
| 3,740,792 | 6/1973 | Werner | 16/180 |
| 4,077,596 | 3/1978 | Pinaire . | |
| 4,290,646 | 9/1981 | Edel | 297/327 |
| 4,744,600 | 5/1988 | Inoue | 297/326 |
| 4,889,384 | 12/1989 | Sulzer | 297/302 |

FOREIGN PATENT DOCUMENTS

| | | | |
|---|---|---|---|
| 669160 | 9/1965 | Belgium | 297/328 |
| 247311 | 12/1987 | European Pat. Off. . | |
| 3530868 | 3/1987 | Fed. Rep. of Germany . | |
| 2627968 | 9/1989 | France . | |

*Primary Examiner*—J. Franklin Foss
*Attorney, Agent, or Firm*—William H. Eilberg

[57] ABSTRACT

The present invention provides a tilting control assembly for a chair which comprises a support mechanism mounted on a chair leg post, a chair seat carried by the support mechanism, and a chair back arranged behind the seat. At least one of the seat and the back constitutes a tiltable member. The tilting control assembly comprises at least one tilting control spring for elastically supporting the tiltable member via at least one contact member, and an adjusting mechanism which is automatically responsive to the weight applied to the seat for causing relative displacement between the tilting control spring and the contact member in a manner such that the spring constant of the tilting control spring increases as the applied weight increases.

19 Claims, 14 Drawing Sheets

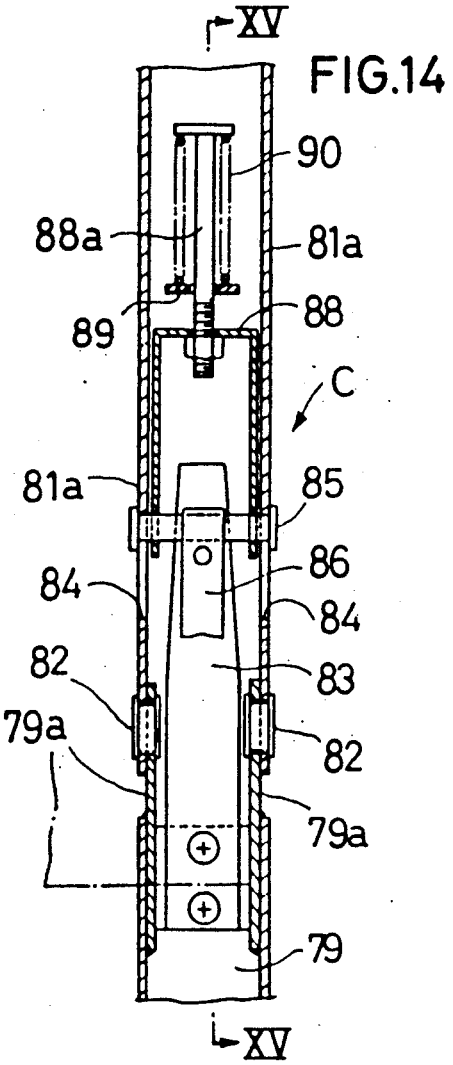
FIG.14
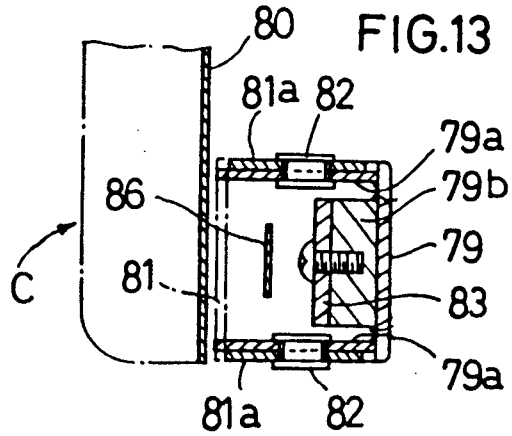
FIG.13
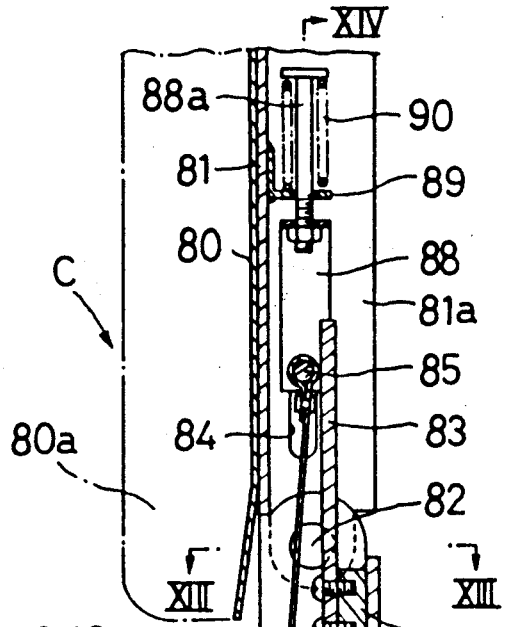
FIG.12
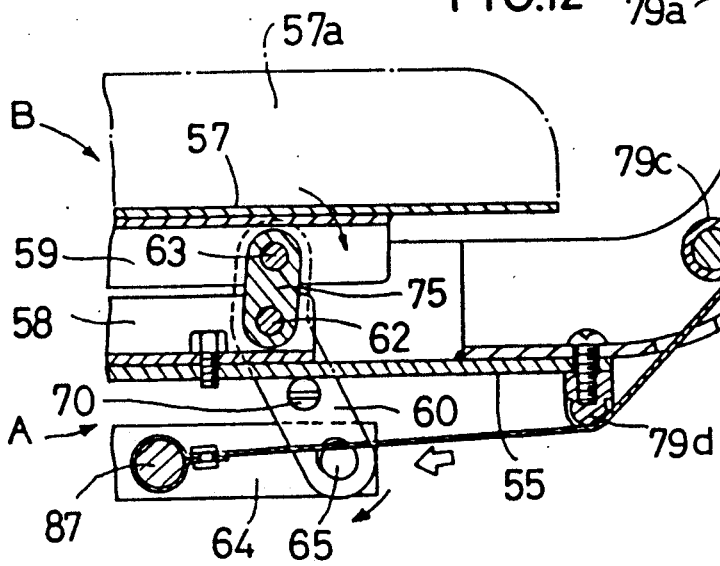

TILTING CONTROL ASSEMBLY FOR CHAIR

BACKGROUND OF THE INVENTION

1. Field of the Invention

This invention relates generally to chairs for use in offices for example. More particularly, the invention relates to chairs of the type wherein the chair seat and/or the chair back are designed to be tiltable at least rearward against a spring or springs.

2. Description of the Prior Art

There have been proposed various types of tiltable chairs wherein at least one of the chair seat and the chair back is tiltable against a tilting control spring or springs. The most typical is a rocking chair wherein the seat is rearwardly tiltable together with the chair back. Such a chair enables the user to assume a relaxing posture occasionally during desk work for example.

As is well known, the degree of tilting of a tiltable chair seat and/or back is generally proportional to the weight of the user but inversely proportional to the spring constant of a tilting control spring or springs. Thus, for a given weight, the tilting degree increases with decreasing spring constant, and decreases with increasing spring constant.

Most commonly used as a tilting control spring is a coil spring whose spring constant is invariable. Thus, a tiltable chair utilizing a tilting control coil spring or springs has a disadvantage that the tilting degree inevitably varies depending on the weight of a particular user with no possibility of adjusting the spring constant.

U.S. Pat. No. 4,077,596 discloses a chair tilting control assembly which comprise a pair of tilting control plate springs each fixed at one end in a cantilever fashion for elastically allowing rearward tilting of the chair seat. Specifically, the weight of the sitter applied to the seat is elastically supported by the plate spring via a U-shaped rod which provides a load applying member carried by the seat. The U-shaped rod is designed to be advanced or retreated relative to the plate spring by manually turning an adjusting screw. Thus, the spring constant of the plate spring can be adjusted to suit the weight of the user.

However, the tilting control assembly of the above U.S. patent is disadvantageous in that it requires manual adjustment upon every change of the user. Further, the manual adjustment is cumbersome and time-taking, so that the user often prefers uncomfortable chair tilting than making such adjustment. Moreover, the manual adjustment is a guess game, and therefore does not necessarily result in comfortable chair tilting.

SUMMARY OF THE INVENTION

It is, therefore, an object of the present invention to provide a chair tilting control assembly which is capable of automatically adjusting the spring constant of the tilting control spring or springs at least with respect to one of the chair seat and the chair back.

Another object of the present invention is to provide a chair tilting control assembly which is capable of automatically adjusting the spring constant of the tilting control spring or springs simultaneously with respect to the chair seat and the chair back.

A further object of the present invention is to make the automatic adjustment of the spring constant highly sensitive to weight variations.

According to one aspect of the present invention, there is provided a tilting control assembly for a chair, the chair comprising a support means mounted on a chair leg means, a chair seat carried by the support means, and a chair back arranged behind the seat, at least one of the seat and the back constituting a tiltable member; the tilting control assembly comprising: a tilting control spring means for elastically supporting the tiltable member via a load applying means, the tilting control spring means being variable in spring constant; and an adjusting means which is automatically responsive to the weight applied to the seat for causing relative displacement between the tilting control spring means and the load applying means in a manner such that the spring constant of the tilting control spring means increases as the weight increases.

With the arrangement described above, the adjusting means automatically responds to the weight of the user to cause relative movement between the load applying means and the tilting control spring means. Thus, the spring constant of the tilting control spring means is adjusted to suit the user's weight without requiring any manual adjustment. As a result, the tilting degree of the tiltable member can be maintained substantially constant for various users having different weights, equally giving them a comfortable relaxing posture.

The adjusting means may include an electric or electronic sensor for detecting the weight of the user. Preferably, however, the adjusting means is designed to mechanically and/or hydraulically respond to the user's weight.

The tilting control spring means and the load applying means can take various forms. For instance, the spring means may comprise at least one elongate spring, whereas the load applying means may comprise at least one contact member, preferably a contact roller, which comes into contact with the elongate spring at a variable longitudinal point (load applying point) thereof. In this case, the spring constant of the elongate spring is adjusted by altering the effective spring span which is subjected to a bending moment.

Alternatively, the tilting control spring means may comprise at least one torsion-bar spring. In this case, the load applying means acts on the torsion-bar spring at a variable point to change the effective spring length which is subjected to a torsional force when the user's weight is applied to the seat.

In the case of using the combination of the elongate spring and the contact member (preferably a contact roller), the tilting control assembly may be simplified in overall arrangement and manufactured at a relatively low cost while ensuring a smooth operation. Further, the elongate spring may be arranged generally in parallel to the chair seat or the chair back in a space-saving manner, as opposed to coil springs which must be arranged perpendicularly to the tiltable member. Thus, the tiltable chair incorporating the elongate spring may be rendered relatively compact.

The width and/or thickness of the elongate spring may vary progressively along its length. In this case, the spring constant of the elongate spring varies sharply for a give displacement of the load applying point, as compared with an elongate spring having a constant width and thickness. Thus, such an elongate spring is capable of sensitively responding to a change in the weight applied to the seat.

Apparently, the tilting control assembly according to the present invention is characterized in automatic adjustability in the spring constant of the tilting control spring. However, this characterizing feature is not exclusive of the possibility of combining the automatic adjustability with manual adjustability.

According to another aspect of the present invention, there is provided a tilting control assembly for a chair, the chair comprising a support means mounted on a chair leg means, a chair seat tiltably carried by the support means, and a chair back tiltably arranged behind the seat; the tilting control assembly comprising: a first tilting control spring means for elastically supporting the seat via a first load applying means, the first tilting control spring means being variable in spring constant; a second tilting control spring means for elastically supporting the back via a second load applying means, the second tilting control spring means being variable in spring constant; and an adjusting means which is automatically responsive to the weight applied to the seat for causing relative displacement between the first tilting control spring means and the first load applying means as well as between the second tilting control spring means and the second load applying means in a manner such that the spring constant of the first and second tilting control spring means increases as the weight increases.

With the arrangement described above, the tilting degree can be automatically adjusted both with respect to the seat and the back only by the single adjusting means. Thus, the cost of the chair does not unacceptably increase due to the provision of the dual adjustability.

Other objects, features and advantages of the present invention will be fully understood from the following detailed description of the embodiments given with reference to the accompanying drawings.

BRIEF DESCRIPTION OF THE DRAWINGS

In the accompanying drawings:

FIG. 12 is a sectional view taken at the same position as FIG. 8 but additionally showing a chair back;

FIG. 13 is a sectional view taken on lines XIII—XIII in FIG. 12;

FIG. 14 is a sectional view taken on lines XIV—XIV in FIG. 12;

DETAILED DESCRIPTION OF THE EMBODIMENTS

Figure 1:
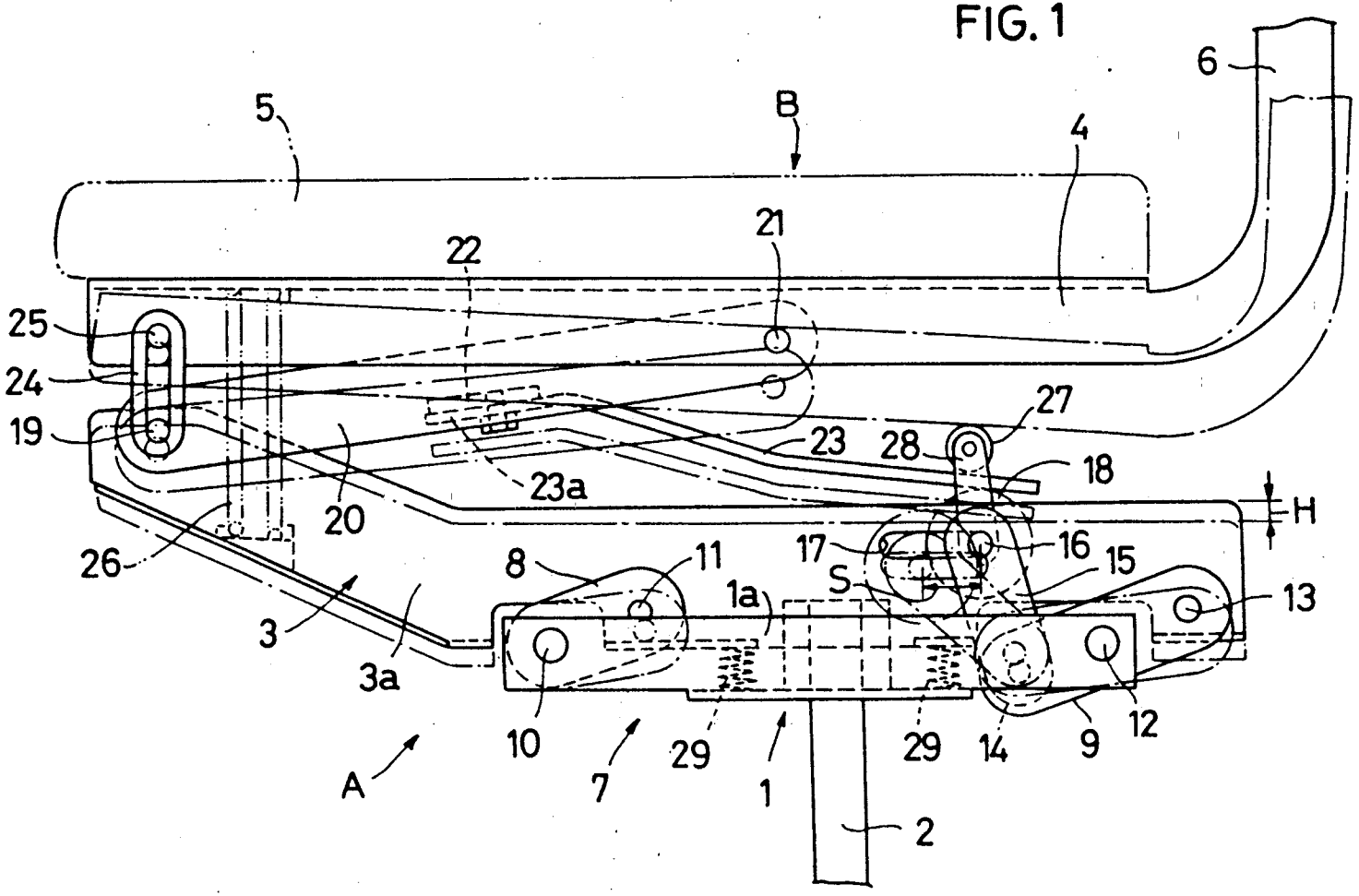
FIG. 1 is a side view showing a rocking chair according to a first embodiment of the present invention.
Figure 2:
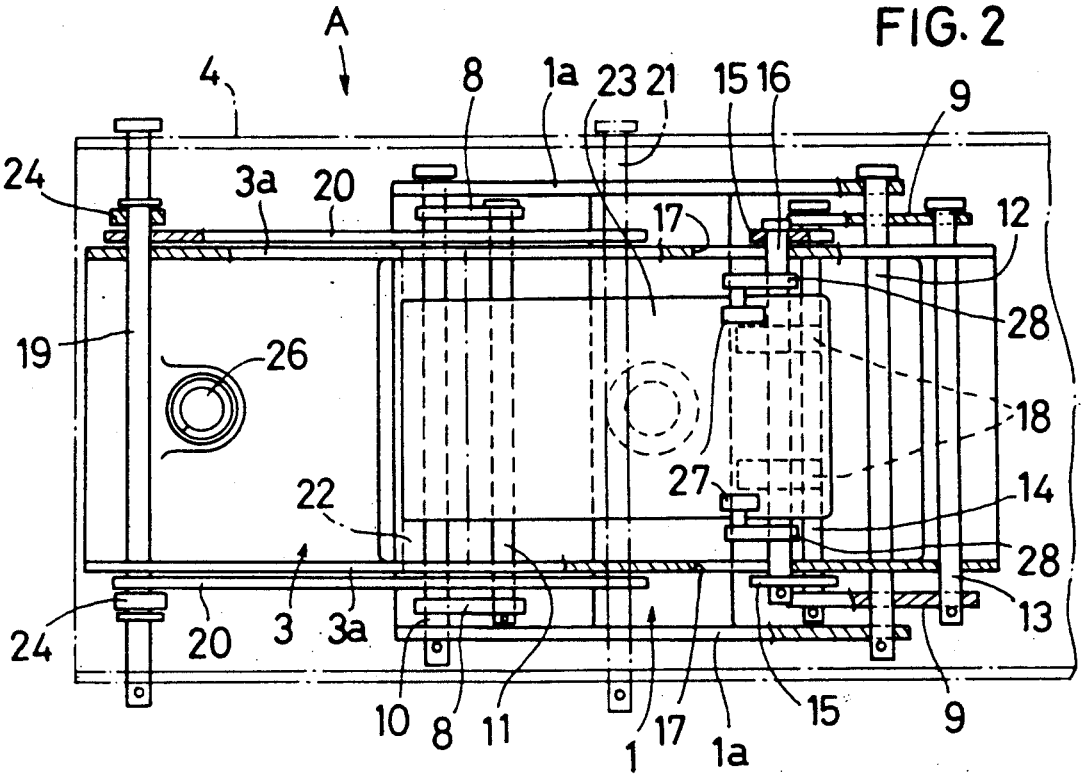
FIG. 2 is a plan view, partially in section, of the same rocking chair with its seat removed.

Referring now to FIGS. 1 and 2 showing a first embodiment of the present invention, there is illustrated a rocking chair which comprises a seat B supported on a support mechanism A. The support mechanism is mounted to the upper end of a chair leg post 2. The seat B includes a seat base 4 fixed to a flat seat plate (not shown), and a cushion 5 attached to the upper side of the seat base 4. According to the illustrated embodiment, the seat base 4 is integrally formed with upstanding back support posts 6 for mounting a chair back (not shown).

The support mechanism A includes a fixed frame 1 which is in the form of a channel member having a pair of upturned side flanges 1*a*. The support mechanism also includes a movable frame 3 which is also in the form of a channel member having a pair of downturned side flanges 3*a*. The movable frame 3 together with the fixed frame 1 constitutes part of a parallelogrammic linkage mechanism 7. Thus, the movable frame 3 is movable in up-and-down and back-and-forth directions relative to the fixed frame 1. The support mechanism further includes a pair of side support links 20, as hereinafter described in detail.

The parallelogrammic linkage mechanism 7 comprises a pair of front links 8 and a pair of rear links 9 in addition to the fixed frame 1 and the movable frame 3. The front links 8 have their lower ends pivotally connected to the side flanges 1*a* of the fixed frame 1 by a common pin 10, whereas the other ends (upper ends) of the front links are pivotally connected to the side flanges 3*a* of the movable frame 3 by a common pin 11. The rear links 9 have their intermediate portions pivotally connected to the side flanges 1*a* of the fixed frame 1 by a common pin 12, whereas the upper ends of the rear links are pivotally connected to the side flanges 3*a* of the movable frame 3 by a common pin 13. There are interposed weight responsive compression springs 29 between the fixed frame 1 and the movable frame 3, so the movable frame is always urged upward.

The rear links 9 further have their lower ends pivotally connected to the lower ends of two operating arms 15, respectively, by means of a common pin 14. The operating arms 15 have their upper ends connected together by a support shaft 16. Both ends of the support shaft 16 are slidably received in longitudinal guide slots 17 which are formed in the respective side flanges 3*a* of the movable frame 3. At a position between the side flanges 3*a* of the movable frame 3, the support shaft 16 rotatably carries a pair of contact rollers 18 which will be hereafter described in detail.

The side support links 20 extend rearward and slightly upward from the front end of the movable frame 3 on both sides thereof. The front ends of the side support links 20 are pivotally connected to the respective side flanges 3*a* of the movable frame 3 by means of a common pin 19, whereas the rear ends of the side support links are pivotally connected to the respective sides of the seat base 4 by means of a common pin 21.

The side support links 20 have their intermediate portions connected together by a cross member 22. This cross member is used to mount a tilting control plate spring 23. Specifically, the plate spring extends rearward and slightly downward from the cross member 22, and has a front end 23*a* fixed to the cross member 22 as by bolting. Thus, the plate spring 23 is supported by the cross member 22 in a cantilever fashion.

The free end of the plate spring 23 rests on the contact rollers 18. Further, the free end of the plate spring is prevented from moving away from the contact rollers 18 by a pair of stopper rollers 28 engaging the plate spring from above. Each of the stopper rollers 27 is rotatably mounted on a bracket 28 which in turn is rotatably mounted on the support shaft 16.

The pin 19 at the front ends of the support links 20 is fitted in a pair of oblong restraining rings 24 which also receive a shaft 25 provided at the front end of the seat base 4. Thus, the restraining rings 24 serve to limit the front end of the seat base 4 (the shaft 25) from moving away from the movable frame 3. The shaft 25 thus limited in movement provides a pivotal axis about which the seat B is tilted rearward. A front compression spring 26 is interposed between the front end of the movable frame 3 and the front end of the seat base 4, so that the pin 19 and the shaft 25 are normally kept maximally away from each other, as shown in FIG. 1.

With the arrangement described above, when the user sits on the seat B, the weight of the user is transmitted through the support links 20 and the cross member 22 to the plate spring 23, so that the plate spring is forcibly pressed at its free end against the contact rollers 18 to elastically support the weight. Thus, the contact rollers 18 work as a load or weight applying means for the plate spring. In this condition, the seat B may be tilted rearward with resulting elastic deformation of the plate spring.

Under the weight of the user, the parallelogrammic linkage mechanism 7 is deformed against the weight responsive springs 29 in a manner such that the movable frame 3 is moved downward toward the fixed frame 1, as shown by phantom lines. As a result, the lower ends of the rear links 9 are pivoted upward together with the pin 14 pivotally connected to the lower ends of the operating arms 15. Since the support shaft 16 connected to the upper ends of the operating arms 15 are slidably received in the guide slots 17 of the movable frame 3, the operating arms 15 are pivoted forward to allow the upward movement of the pin 14. Therefore, the contact rollers 18 shift toward the fixed end 23*a* of the plate spring 23, thereby reducing the effective length of the plate spring to increase the spring constant thereof.

Obviously, the deformation of the weight responsive springs 29 is substantially proportional to the weight exerted on the seat B. Therefore, a heavier user causes a larger downward movement H than a lighter user, providing a larger horizontal shift S of the contact rollers 18. This means that the spring constant of the plate spring 23 can be automatically adjusted depending on the particular weight of the user.

According to the embodiment shown in FIGS. 1 and 2, each of the oblong restraining rings 24 limits the front end of the seat base 4 from lifting away from the movable frame 3. Thus, the restraining ring 24 is capable of preventing the seat B from excessively tilting rearward while also preventing the sitter's thighs from being unacceptably pushed up during such rearward rocking. Further, the restraining ring 24 allows the front end of the seat B to move downward against the front compression spring 26, thereby enabling forward rocking movement of the seat when the user assumes a crouching posture.

Figure 3:
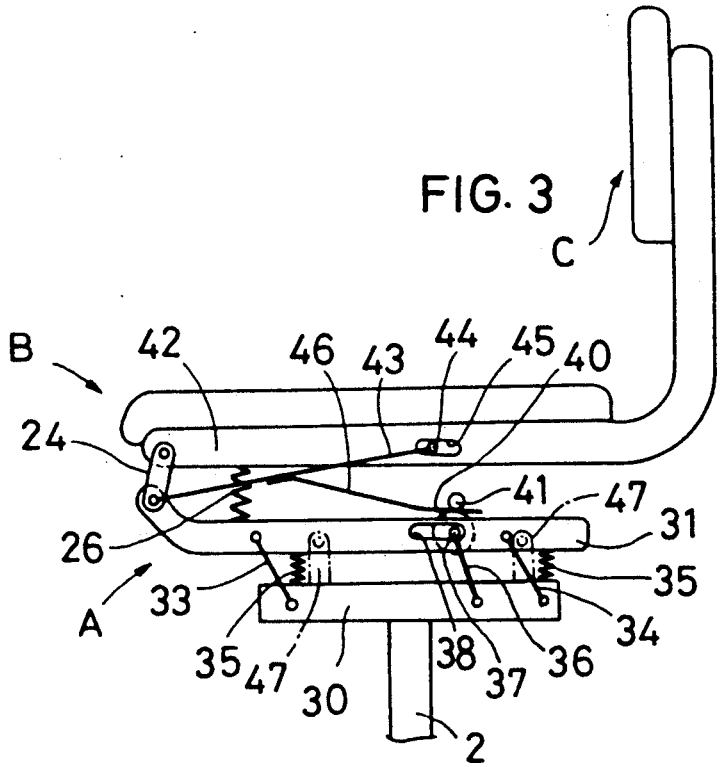
FIG. 3 is a side view showing a rocking chair according to a second embodiment of the present invention.

FIG. 3 schematically illustrates a second embodiment of the present invention which is a slight modification from the first embodiment described above. The rocking chair according to this embodiment also comprises a support mechanism A mounted to the upper end of a chair leg post 2, and a seat B tiltably carried on the support mechanism. Further shown is a chair back C located behind the seat in a well known manner.

The support mechanism A includes a fixed frame 30, a movable frame 31, a pair of front links 33, and a pair of rear links 34. These parts together constitute a parallelogrammic linkage mechanism which, under the weight of the sitter, allows the movable frame 31 to move downward and forward relative to the fixed frame 30. Weight responsive compression springs 35 are interposed between the fixed frame and the movable frame.

A pair of operating arms or links 36 are pinned at their lower ends to the respective sides of the fixed frame 30. The operating arms 36 are inclined forward, but their inclination is slightly smaller than the inclination of the front and rear links 33, 34. The upper ends of the operating arms 36 are connected together by a support shaft 37 which slidably penetrates through longitudinal guide slots 38 of the movable frame 31.

A pair of contact rollers 40 associated with a corresponding pair of stopper rollers 41 are rotatably mounted on a central portion of the support shaft 37. The manner of arrangement of the contact rollers 40 and the stopper rollers 41 may be exactly the same as shown in FIGS. 1 and 2.

A pair of support links 43, which extend rearward and slightly upward, have their front ends pivotally connected to the front end of the movable frame 31 on both sides thereof. The rear ends of the support links 43 are connected together by a common pin 44 which slidably penetrates through longitudinal guide slots 45 of a seat base 42. The support links 43 supports a tilting control plate spring 46 which extends rearward and slightly downward to rest, at its free end, on the contact rollers 40 under the stopper rollers 41. Reference numeral 24 designates a pair of oblong restraining rings, whereas reference numeral 26 indicates a front compression spring.

According to the second embodiment shown in FIG. 3, when the weight of the user is applied to the seat B, the movable frame 31 is moved downward and forward against the weight responsive springs 35, and the links 33, 34 as well as the operating arms 36 are pivoted forward. As already described, the operating arms 36 are inclined forward to a smaller degree than the links 33, 34 of the parallelogrammic linkage mechanism. Thus, the support shaft 37 connecting between the upper ends of the operating arms 36 moves forward to a greater degree than the movable frame 31, thereby causing the contact rollers 40 to advance relative to the plate spring 46. As a result, the spring constant of the plate spring 46 is automatically adjusted depending on the weight of the user.

As indicated by phantom lines in FIG. 3, the links 33, 34 of the parallelogrammic linkage mechanism may be replaced by two pairs of vertical guides 47 which allow the movable frame 31 to move only in the vertical direction.

Figure 4:
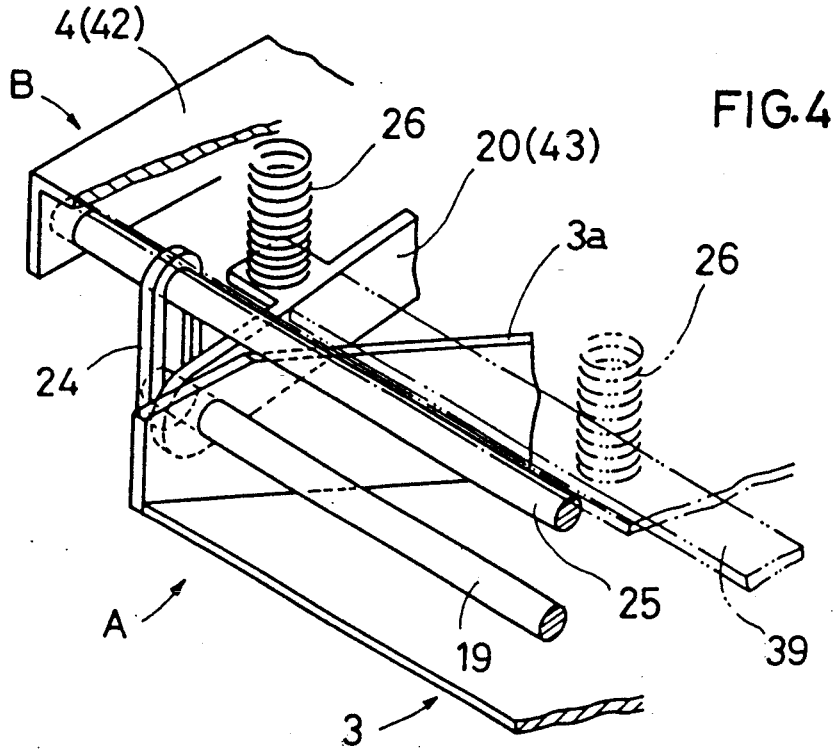
FIG. 4 is a fragmentary perspective view showing a modification to be applied to the first or second embodiment.
Figure 5:
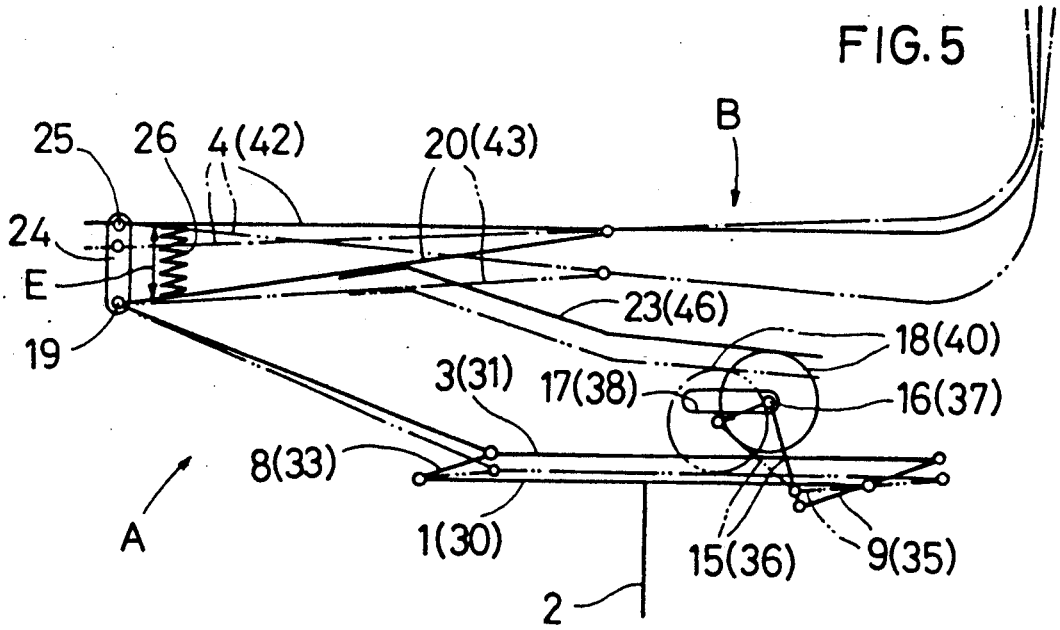
FIG. 5 is a schematic side view illustrating the operation of the modified rocking chair shown in FIG. 4.
Figure 6:
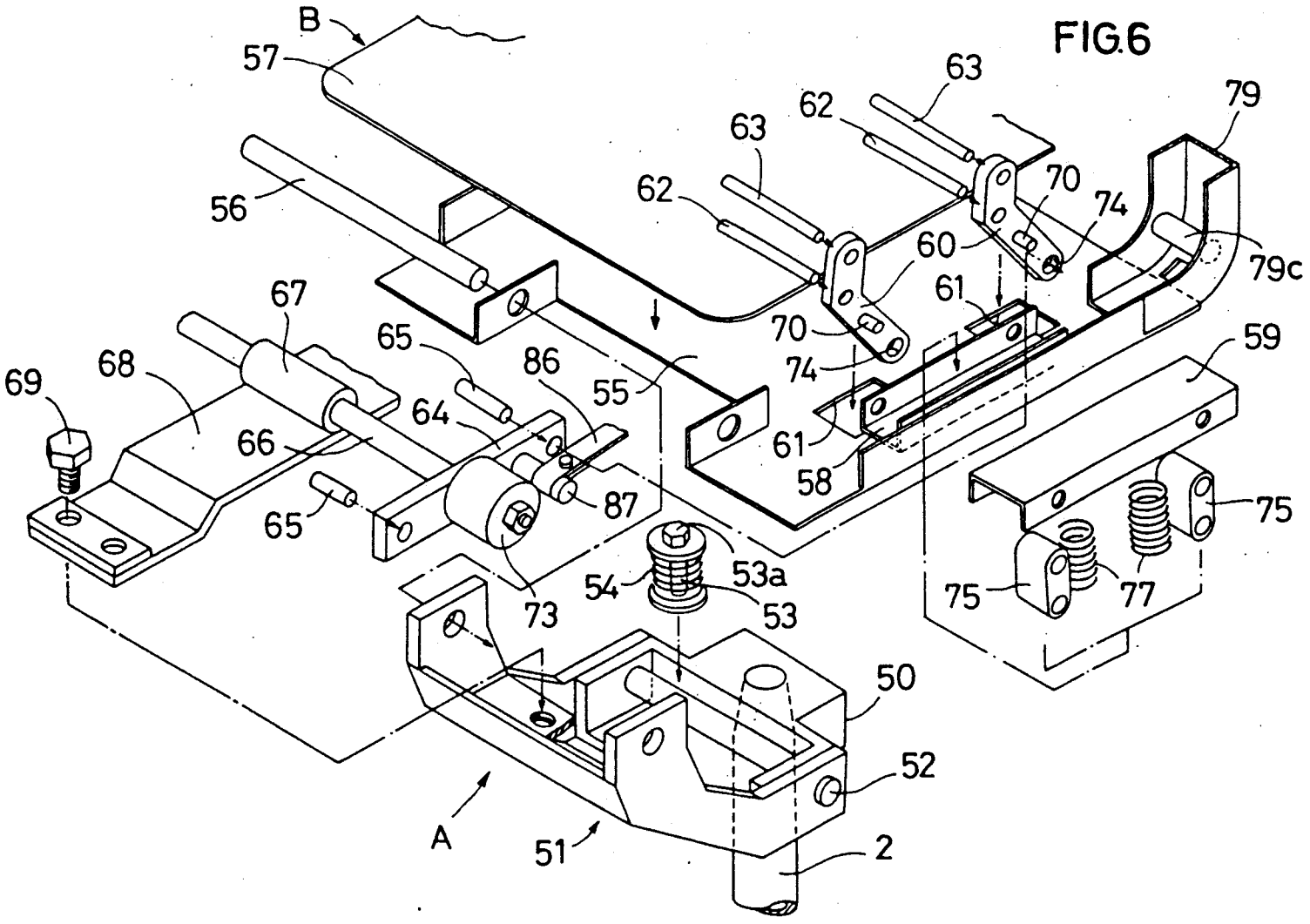
FIG. 6 is an exploded perspective view showing a rocking chair according to the third embodiment of the present invention.

The foregoing two embodiments may be further modified as shown in FIGS. 4 and 5. Specifically, a spring support member 39 is bridged between the front ends of the support links 20 (43), and one or more front compression springs 26 are interposed between the underside of the seat base 4 (42) and the spring support member 39.

According to the modification of FIGS. 4 and 5, when the seat base 4 (42) is tilted forward as indicated by a one-dot chain line in FIG. 5, the oblong restraining rings 24 allows movement of the seat base front end toward the movable frame 3 (31) to reduce the length E of the front compression springs 26. Thus, the front springs are effective in controlling the forward tilting of the seat base. On the other hand, when the seat base is tilted rearward, the support links 20 (43) are correspondingly pivoted rearward (downward), as indicated by two-dot chain lines in FIG. 5. Thus, the length E of the front compression springs 26 remains substantially unchanged. As a result, the front springs have substantially no influence on the seat rearward tilting which, for this reason, is controlled solely by the tilting control plate spring 23 (46).

FIGS. 6 to 15 represent a third embodiment of the present invention. The rocking chair according to this embodiment again comprises a support mechanism A and a seat B.

Figure 11:
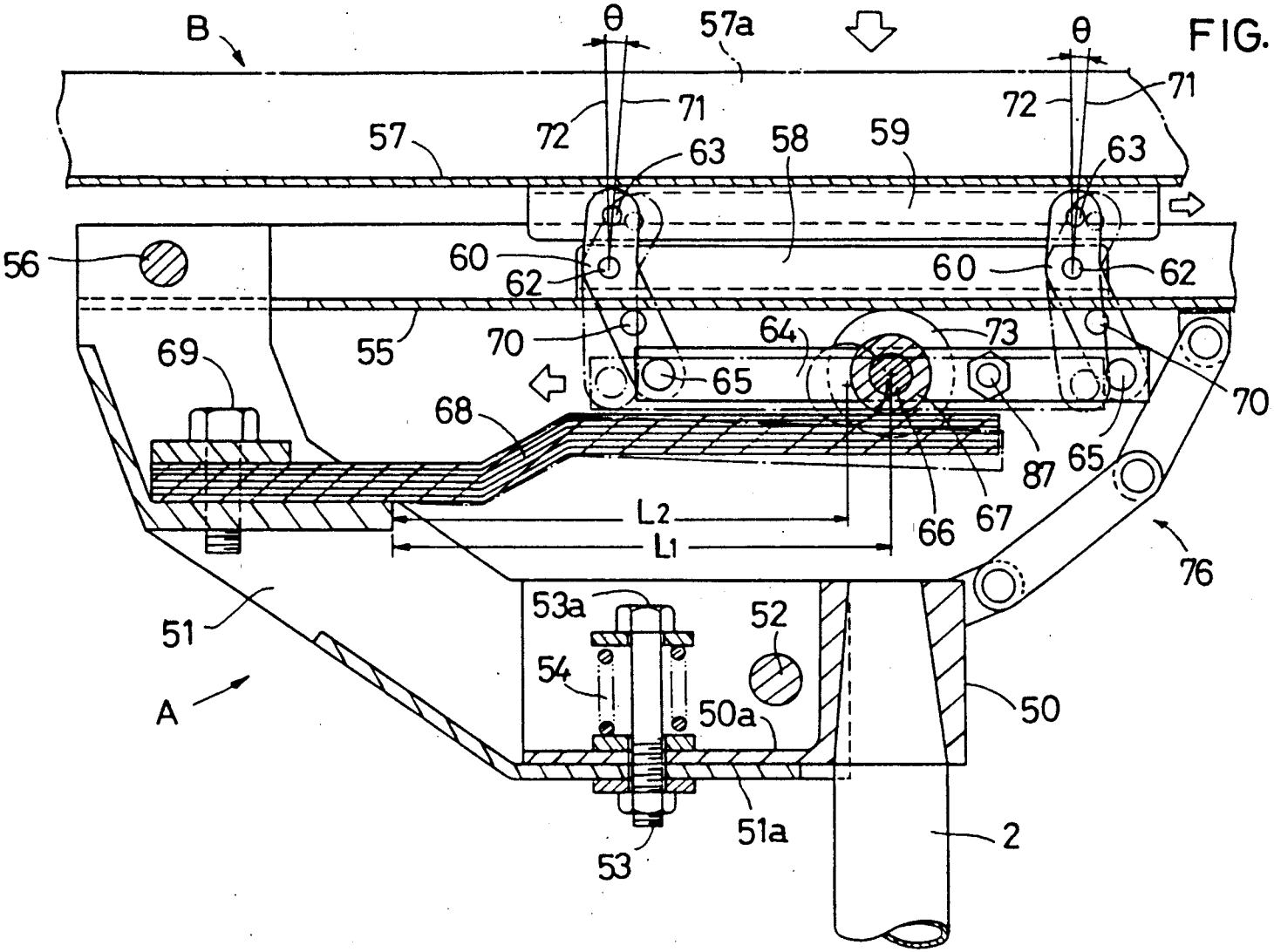
FIG. 11 is a sectional view taken along lines XI—XI in FIG. 7.

The support mechanism A includes a fixed frame 50 secured to the upper end of a chair leg post 2 and having a bottom plate 50*a* (FIG. 11). The support mechanism A further includes a pivotal frame 51 extending forwardly upward from the fixed frame and pivotally connected to the fixed frame by means of a horizontal pin 52. The pivotal frame 51 also has a bottom plate 51*a* (FIG. 11). The respective bottom plates 50*a*, 51*a* of the fixed and pivotal frames 50, 51 are loosely penetrated by a bolt 53 which is made to engage with the bottom plate 51*a* of the pivotal frame from below. The bolt 53 has a head 53*a*, and a coil spring 54 is interposed between the bolt head 53*a* and the bottom plate 50*a* of the fixed frame. Thus, the pivotal frame is normally urged upward by the coil spring, but may be pivoted downward against the spring force.

The seat B includes a seat base 55 pivotally connected at its front end to the front (upper) end of the pivotal frame 51 by means of a horizontal pin 56. The seat further comprises a substantially flat seat plate 57 covering over the seat base, and a cushion 57*a* (see FIG. 8) mounted on the seat plate.

On the seat base 55 adjacent to both sides thereof, there are fixed a pair of lower channel members 58 which are upwardly open and extend in the back-and-forth direction. Similarly, the seat plate 57 is fixedly provided with a pair of upper channel members 59 which are downwardly open and located over the pair of lower channel members 58 in corresponding relation thereto. The upper and lower channel members constitute a parallelogrammic linkage mechanism in combination with front and rear pairs of bent links 60.

Each of the bent links 60 projects downward through a corresponding opening 61 of the seat base 55, and has an intermediate portion pivotally connected to the corresponding lower channel member 58 by a pin 62. The bent link also has an upper end pivotally connected to the corresponding upper channel member 59 by a pin 63.

Two bent links 60 located on each side of the seat base 55 are pivotally connected to an operating arm 64 by means of pins 65. The operating arm is connected to the other operating arm (on the opposite side) by a support shaft 66 which rotatably carries a contact roller 67.

As best shown in FIG. 11, a tilting control plate spring 68 has a front end fixed to the pivotal frame 51 by a bolt 69, so that the plate spring is supported in a cantilever fashion. The plate spring, which is made by laminating a plurality of thin leaves, extends rearward for contact with the contact roller 67 from below. The contact point between the plate spring and the contact roller is always located behind the pin 52 which provides a pivotal center of the pivotal frame 51. Therefore, a normal sitting posture of the user will not cause unexpected downward (forward) pivoting of the pivotal frame.

Figure 7:
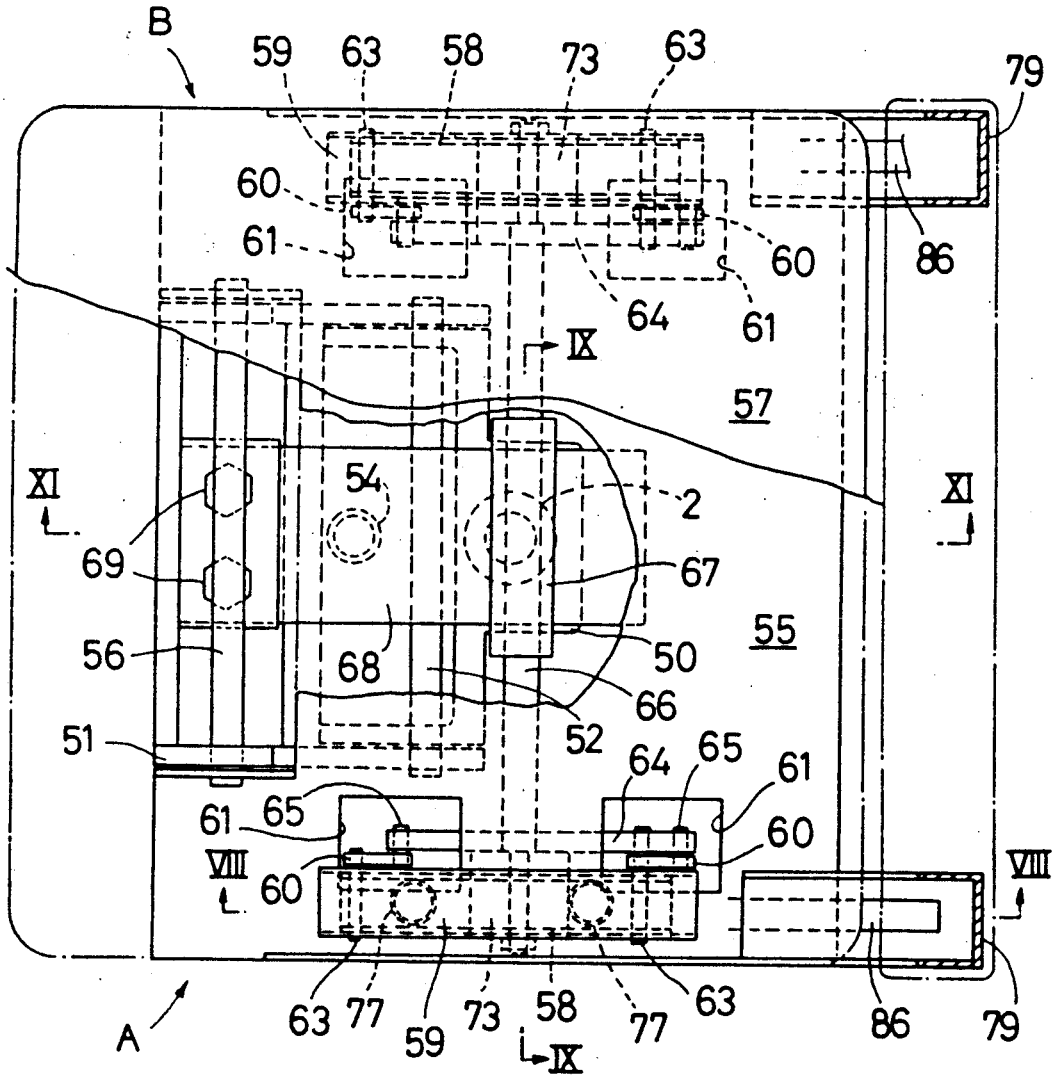
FIG. 7 is a plan view showing the rocking chair of FIG. 6 with its seat partially cut away.
Figure 8:
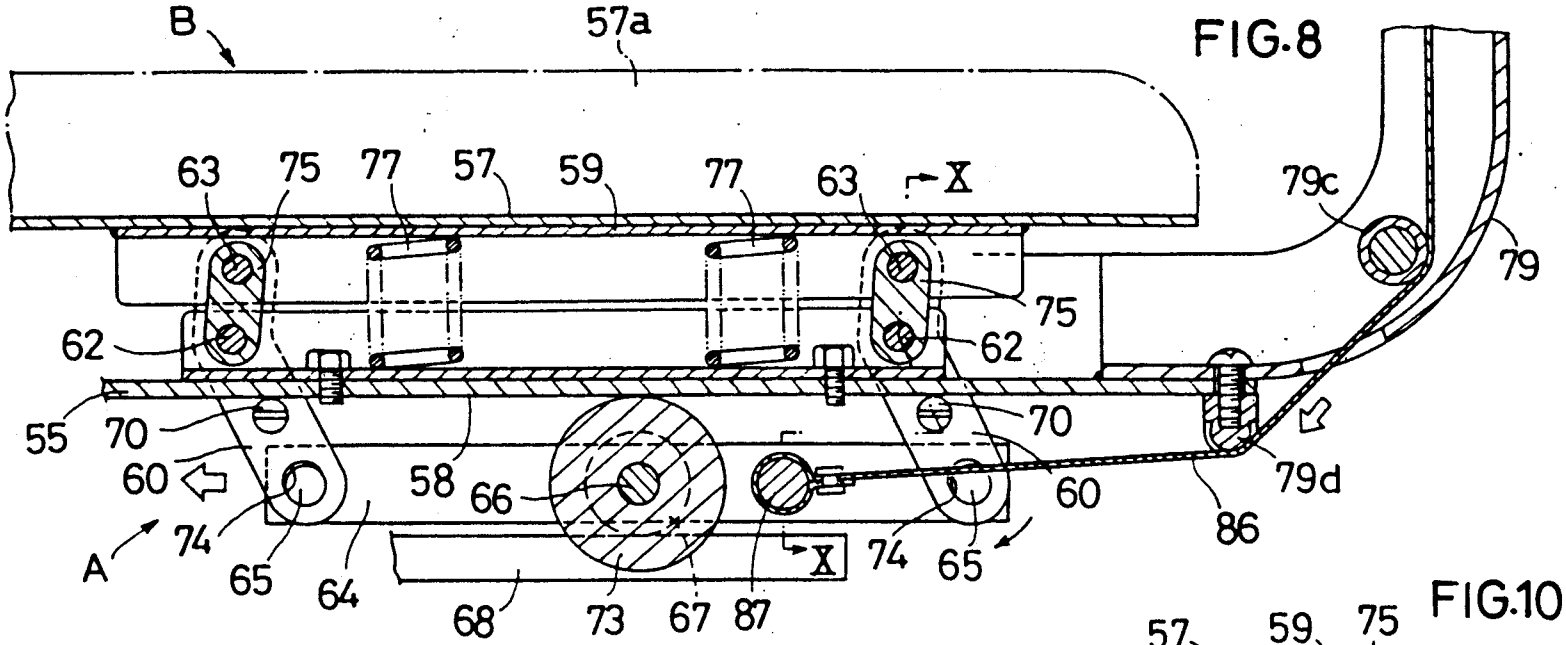
FIG. 8 is a sectional view taken on lines VIII—VIII in FIG. 7.

As shown in FIGS. 7 and 8, weight responsive compression springs 77 are interposed between each lower channel member 58 and the corresponding upper channel member 59. Thus, the upper channel member 59 is always urged away from the lower channel member 58.

Each of the bent links 60 is formed with a lateral stopper projection 70 which is engageable with the seat base 55 from below when each upper channel member 59 is urged maximally away from the corresponding lower channel member 58 by the weight response compression springs 77. The position of the stopper projection 70 is determined so that when it comes into engagement with the seat base 55, a line 71 passing through the pins 62, 63 is inclined rearward by a suitable angle 0 from a vertical line 72, as shown in FIG. 11. Due to such an arrangement, it is always ensured that the seat B is displaced rearwardly downward upon weight application.

The support shaft 66 further carries, at both ends, a pair of support rollers 73 for contact with the seat base 55 from below. Thus, the weight of the sitter is transmitted to the tilting control plate spring 68 by way of the support rollers 67, the support shaft 66 and the contact roller 67.

As best shown in FIG. 8, the lower end of each bent link 60 is formed with a slightly elongated bore 74 for receiving the corresponding pin 65. Thus, the distance between the seat base 55 and the tilting control plate spring 68 remains substantially unchanged even if the bent link 60 is pivoted. This arrangement is significant in ensuring smooth advancing movement of the contact roller 67, as described hereinafter.

Figure 10:
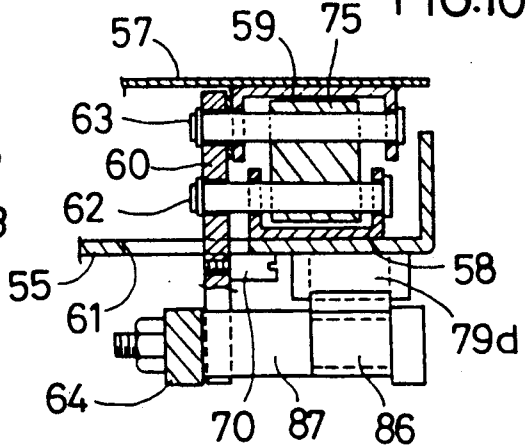
FIG. 10 is a sectional view taken along lines X—X in FIG. 8.
Figure 9:
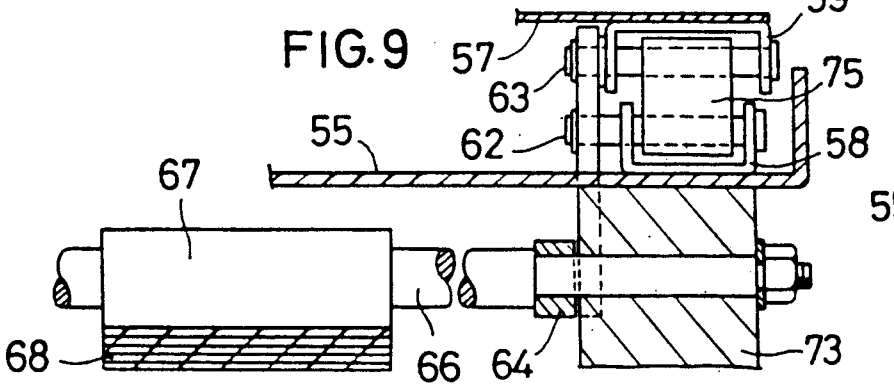
FIG. 9 is a sectional view taken on lines IX—IX in FIG. 7.

Between each lower channel member 58 and the corresponding upper channel member 59, there are preferably arranged auxiliary links 75 in corresponding relation to the bent link 60, as shown in FIGS. 8 to 10. Each auxiliary link 75 pivotally connects between the corresponding pins 62, 63 to assist the function of the corresponding bent link.

As shown in FIG. 11, a restraining link train 76 has one end connected to the fixed frame 50, whereas the other end of the link train is connected to the seat base 55. The link train functions to limit the pivotal frame 51 (together with the seat B) from excessively pivoting forwardly downward about the pin 52 against the coil spring 54. Such downward pivoting of the pivotal lever takes place only when the weight center of the sitter is shifted forward from a normal sitting position.

According to the third embodiment, when the user sits on the seat B, the seat plate 57 is displaced downward toward the seat base 55 against the weight responsive springs 77 (FIG. 8). Such downward movement of the seat plate causes the bent links 60 to pivot so that their lower ends are moved forward together with the operating arms 64, as indicated in phantom lines in FIG. 11. As a result, the contact roller 67 advances relative to the tilting control plate spring 68 to provide a new loading bearing span L2 of the plate spring which is smaller than the original span L1, thereby increasing the spring constant of the plate spring.

The degree of the advancing movement of the contact roller 67 is generally proportional to the weight of the sitter due to the function of the weight responsive springs 77. Therefore, the spring constant of the tilting control plate spring 68 is automatically adjusted depending on the weight of the sitter.

The third embodiment shown in FIGS. 6 through 15 further incorporates a chair back C (see FIG. 12) which is also rendered tiltable against a second tilting control plate spring 83. Similarly to the seat B, the tilting of the back C is automatically controlled depending on the weight of the user sitting on the seat B.

Specifically, as better illustrated in FIGS. 12 through 15, a pair of back support posts 79 are fixed to the rear end of the seat base 55 to extend upward therefrom, and mounting brackets **79*a* are fixed to the respective upper ends of the back support posts. The chair back C comprises a back mounting frame 81 pivotally connected at its lower end to the mounting brackets 79*a* by horizontal pins 82, and a back plate 80 attached to the back mounting frame and carrying a cushion 80*a*. Though not clearly shown, the back mounting frame 81 has the shape of an inverted U in rear view, and is made of a channel member having a pair of side flanges 81*a***.

A second tilting control plate spring 83, which extends vertically, is bolted at its lower end to the upper end of each back support post 79 via a spacer **79*a*. The side flanges 81*a* of the back support frame 81 are formed with vertical guide slots 84 for slidably receiving a contact pin 85 which is connected to one end of a pull band 86. The other end of the pull band 86 is connected to the corresponding operating arm 64 by means of an engaging pin 87 (see also FIGS. 6 and 7). The back support post 79 is provided with a guide roller 79*c* and a slide guide 79*d* both for guiding intermediate portions of the band 86**.

Each contact pin 85 is supported by a vertical carrier 88 which in turn is connected to a carrier bolt **88*a*. The back support frame 81 is fixedly provided with an L-shaped bracket 89 a position slightly above the carrier 88. The carrier bolt 88*a* loosely penetrates through the L-shaped bracket 89, and is always urged upward by a compression spring 90**.

According to the third embodiment, the chair back C is tiltable rearward about the pins 82 independently of the tilting of the chair seat B. Such tilting of the chair back C is controlled by the second tilting control plate springs 83 each of which is held in contact with the corresponding contact pin 85 and elastically deformed upon pivoting of the chair back.

Figure 15:
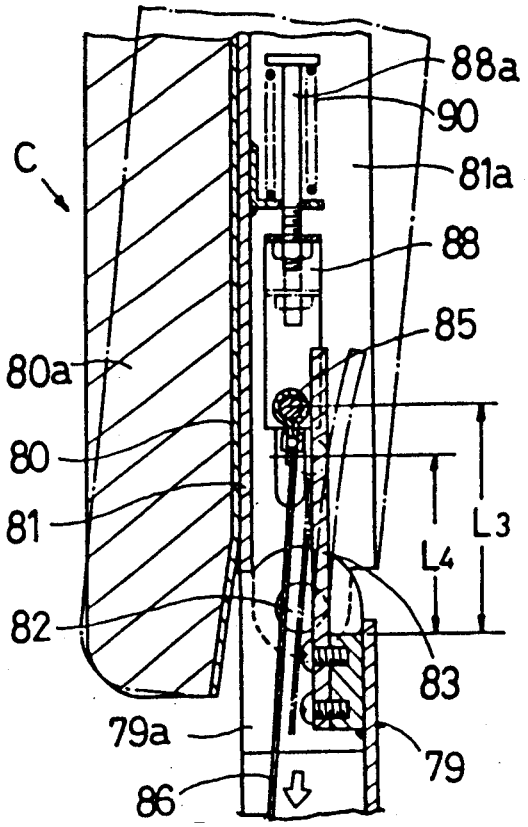
FIG. 15 is a sectional view taken on lines XV—XV in FIG. 14.

When the seat B is pressed downward under the weight of the user, each operating arm 64 is advanced relative to the seat base 55, as already described. Such advancing movement of the operating arm 64 is transmitted through the corresponding pull band 86 to cause the contact pin 85 to move downward against the compression spring 90. As a result, the load supporting span of the second tilting control spring 83 is reduced from an initial value L3 to a new one L4 (FIG. 15).

Obviously, the degree of the downward movement of the contact pins 85 is generally proportional to the weight of the user. Thus, the spring constant of the second tilting control springs 83 is automatically adjusted to suit the weight of the particular user.

Figure 16:
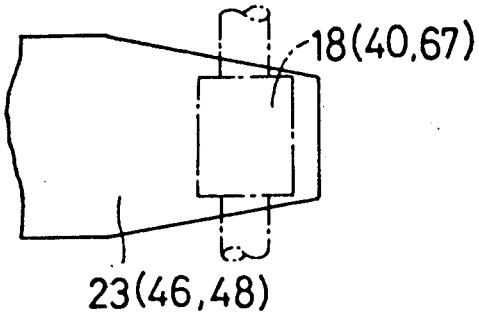
FIG. 16 is a plan view showing a modified first tilting control spring to be incorporated in any of the foregoing embodiment.
Figure 17:
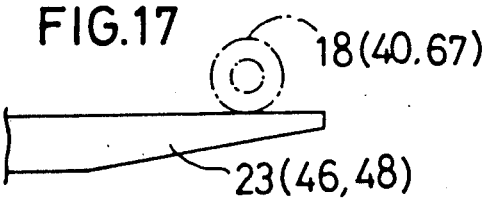
FIG. 17 is a side view showing another modified first tilting control spring.

In either of the foregoing embodiments, the tilting control plate spring 23 or 46 or 68 (first tilting control spring) for the chair seat B is supported in a cantilever manner and has a uniform width and thickness over its entire length. However, the first tilting control spring may be modified to have a progressively reducing width toward its free end, as shown in FIG. 16. Further, the first tilting control spring may be also modified to have a progressively reducing thickness toward its free end, as shown in FIG. 17. It is of course possible to modify the first tilting control spring to have a progressively reducing width and thickness toward its free end.

In either of the modifications shown in FIGS. 16 and 17, the first tilting control spring 23 (46, 68) decreases in second moment of area toward its free end. Thus, the spring constant of the tilting control spring varies very sharply for a given displacement of the contact roller 18 (40, 67). As a result, the tilting control spring can be rendered highly sensitive to the weight of the user.

Similarly, the second tilting control plate spring 83 for the chair back C is also made to have a progressively reducing width toward its free end, as shown in FIG. 14. However, the second spring may be modified to alternatively or additionally have a progressively reducing thickness toward its free end in the same manner as shown in FIG. 17. Further, the second spring may have a constant width and thickness throughout its entire length if so desired.

The contact roller 18 or 40 or 67 (see FIGS. 16, 17) comes into rolling contact with the first tilting control spring 23 or 46 or 68 to provide an adjustable load applying point. Such rolling contact is preferred in ensuring smooth movement. However, it is of course possible to replace the contact roller by a sliding member which comes into sliding contact with the first tilting control spring.

Figure 18:
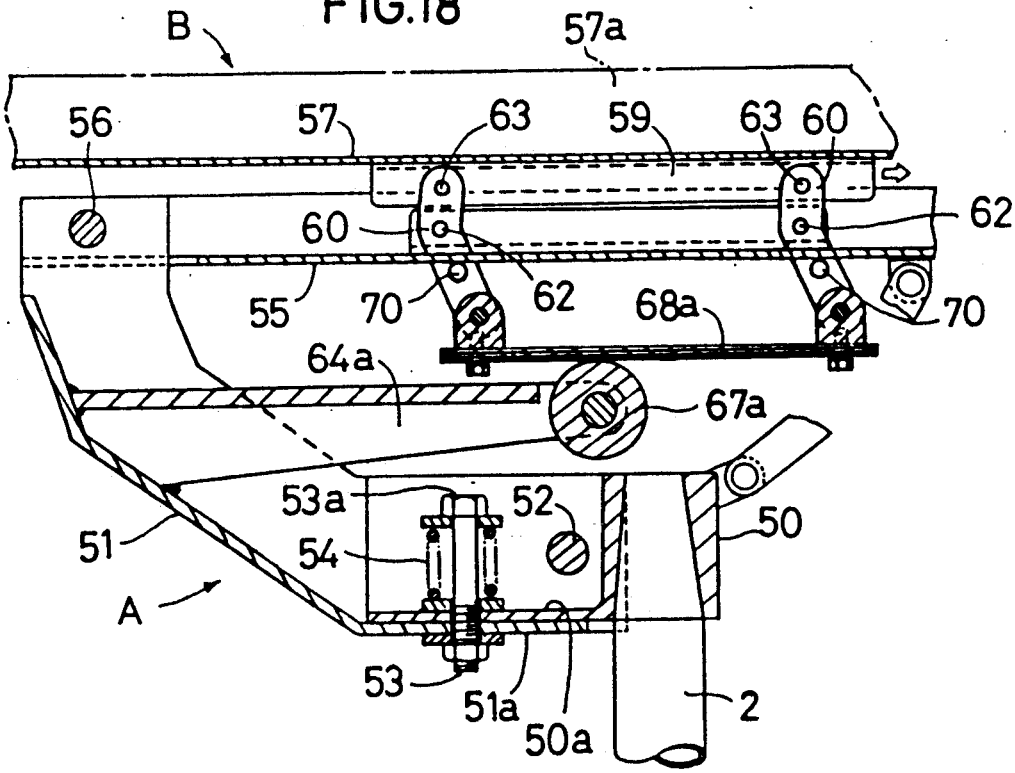
FIG. 18 is a side view, in central vertical section, showing a rocking chair according to a fourth embodiment of the present invention.

FIG. 18 represents a fourth embodiment which is a slight modification of the third embodiment previously described. According to the fourth embodiment, each operating arm 64 of the third embodiment (see particularly FIG. 8) is replaced by a tilting control plate spring **68*a* which is supported at both ends by the lower ends of the respective bent links 60. On the other hand, the pivotal frame 51 is integrally formed with a rearwardly extending support 64***a* which in turn rotatably carries a contact roller 67*a* for rolling contact with the corresponding tilting control spring 68*a*. The support 64*a* is generally rigid, but may be made elastic.

As is well known in the art, a beam supported at both ends provides a highest spring constant when a load applying point is located at the longitudinal center of the beam. Thus, in the fourth embodiment, each contact roller 67*a* need be initially located ahead of the central position of the beam-like spring 68*a*, as shown in FIG. 18.

In operation, when the weight of the user is applied to the chair seat B, each tilting control spring 68*a* advances relative to the corresponding contact roller 67*a* which is fixed. Thus, the load applying point provided by the contact roller shifts rearward toward the center of the tilting control spring, thereby increasing the spring constant of the tilting control spring depending on the weight of the user.

The modification illustrated in FIG. 18 may be applicable also to the tilting control springs for the chair back C. For example, each second tilting control spring 83 shown in FIGS. 14 and 15 (third embodiment) may be modified to be vertically movable with its both ends supported, whereas the contact pin 85 may be modified to assume a fixed position. Further, the pin 85 may support a contact roller which comes into rolling contact with the second tilting control spring.

Figure 19:
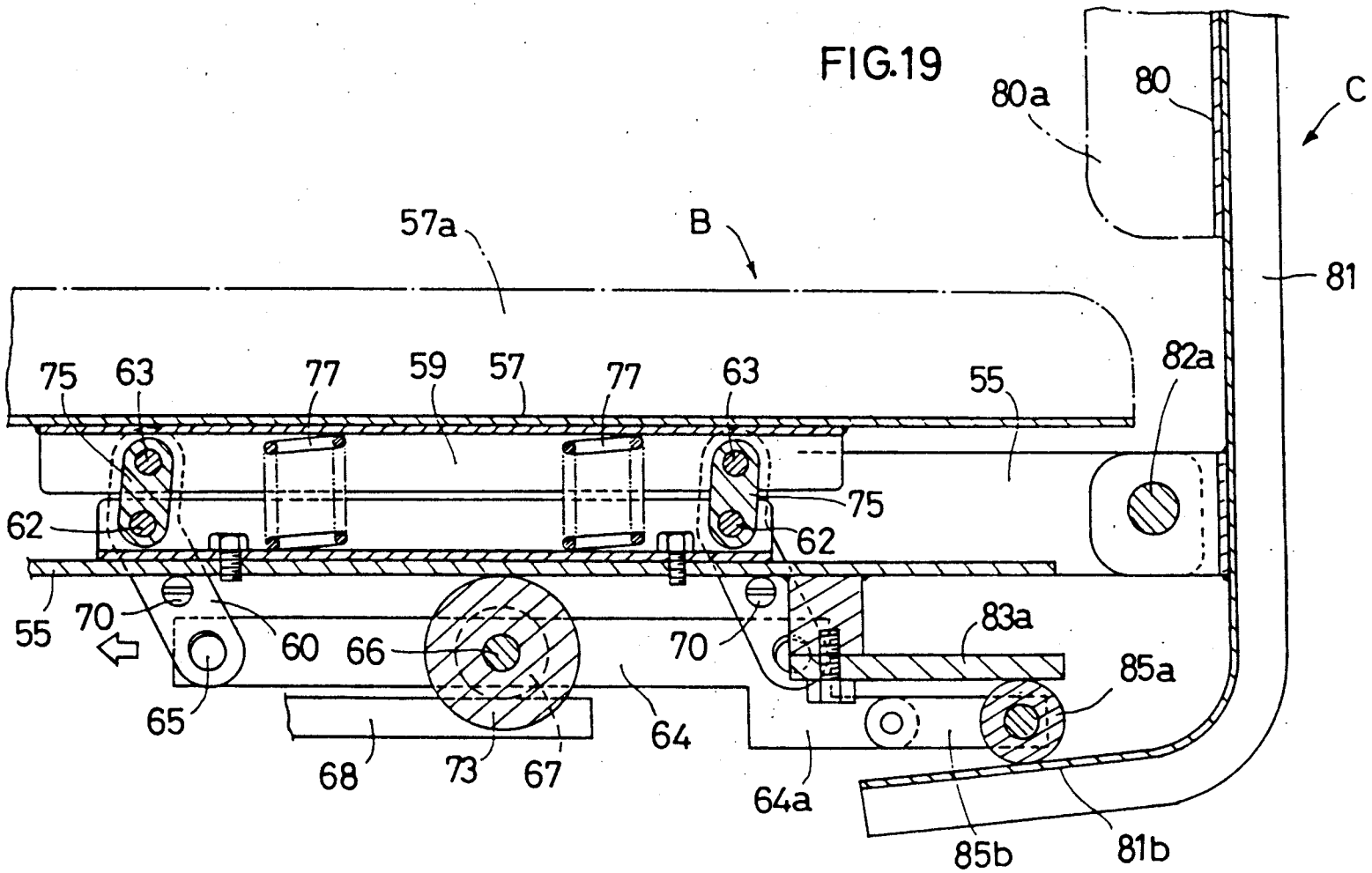
FIG. 19 is a side view, in central vertical section, showing a rocking chair according to a fifth embodiment of the present invention.

FIG. 19 shows a fifth embodiment which is also a slight modification of the third embodiment previously described. The modified chair includes a chair back C comprising a back support frame 81 which is directly pivoted to the rear end of the seat base 55 by a pin 82*a*. Thus, the chair back C is tiltable about the pin. The back support frame has a forwardly directed lower portion 81*b* located below the seat base 55.

Each of the operating arms 64 rotatably supporting a first contact roller 67 in contact with the first tilting control plate spring 68 is extended rearward to provide a rear mounting end 64*a*. A pull link 85*b* pinned to the rear end 64 of the operating arm 64 rotatably supports a second contact roller 85*a* in contact with the lower portion 81*b* of the back support frame 81. A second tilting control plate spring 83*a* is fixedly supported at one end by the seat base 55 in a cantilever fashion. Thus, the second contact roller 85*a* is sandwiched between the second tilting control spring 83*a* and the lower portion 81*b* of the back support frame.

When the sitter's weight is applied to the seat B, each operating arm 64 moves forward, so that the first and second contact rollers 67, 85*a* simultaneously advance relative to the first and second tilting control springs 68, 83*a*, respectively. Thus, the spring constant of the first and second tilting control springs are automatically adjusted depending on the weight of the user.

FIGS. 20 to 23 show a sixth embodiment which differs from the third embodiment only in the arrangement for causing the shifting of the load applying point relative to the first tilting control plate spring 68. The seat plate 57 of the rocking chair according to the sixth embodiment is movable toward and away from the the seat base 55 by means of a front pantograph mechanism 96 and a rear pantograph mechanism 101.

The front pantograph mechanism 96 comprises a pair of front lower channel members 92 located on both sides of the seat base 55 to open upward, and a pair of front upper channel members 94 located in corresponding relation to the front lower channel members to open downward. Similarly, the rear pantograph mechanism 101 comprises a pair of rear lower channel members 93 located on both sides of the seat base to open upward, and a pair of rear upper channel members 95 located in corresponding relation to the rear lower channel members to open downward.

Each of the channel members has a pair of side flanges each formed with a longitudinal guide slot 102. The lower channel members 92, 93 are connected to the corresponding upper channel members 94, 95 by pantograph links 97 which have an interconnecting center pins 99, upper pins 98 slidably fitted in the guide slots of the upper channel members, and lower pins 100 slidably fitted in the guide slots of the lower channel members. Thus, the pantograph mechanisms allow the seat plate 57 to move toward and away from the seat base 55 within a limited range.

Figure 21:
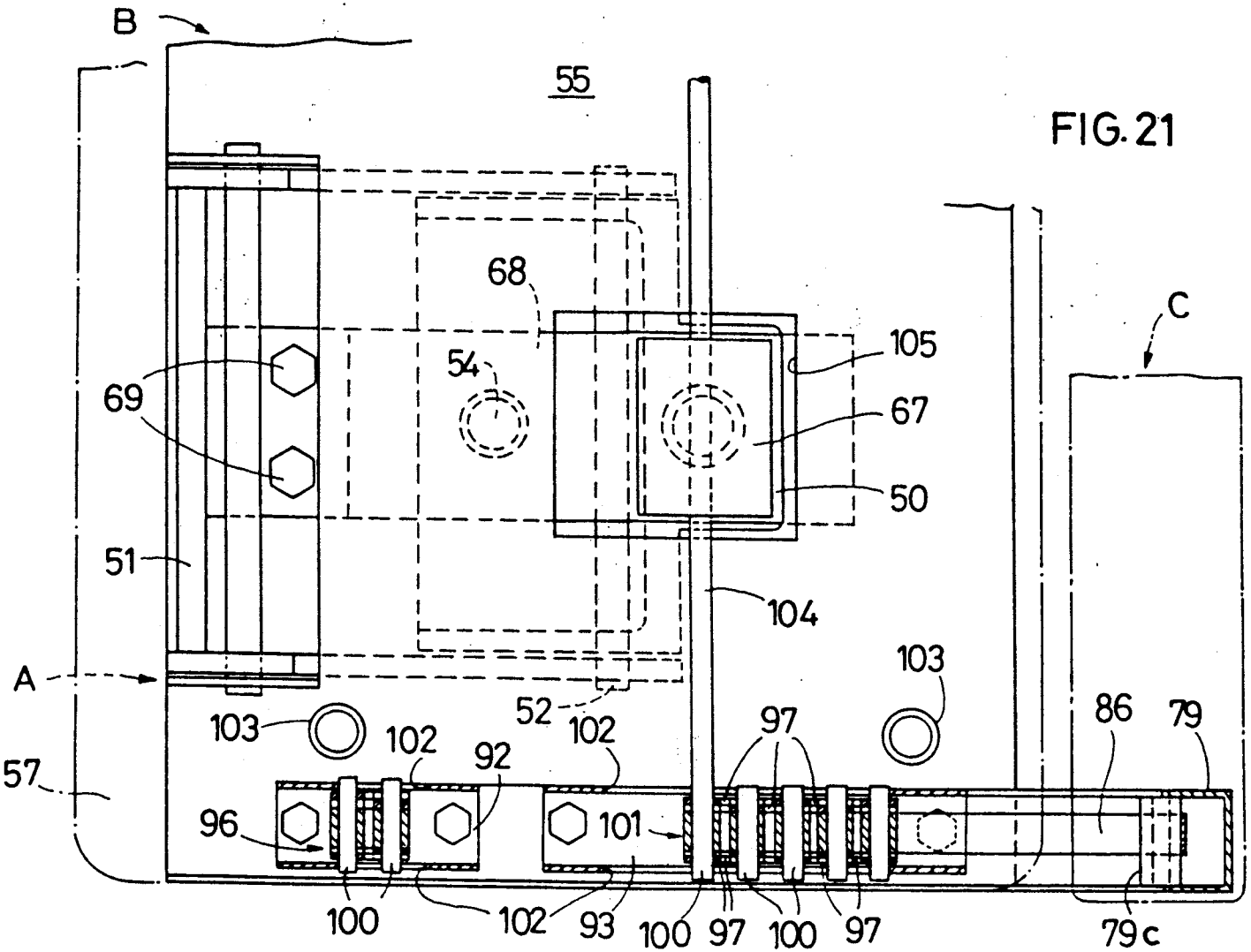
FIG. 21 is a section taken on lines XXI—XXI in FIG. 20.
Figure 22:
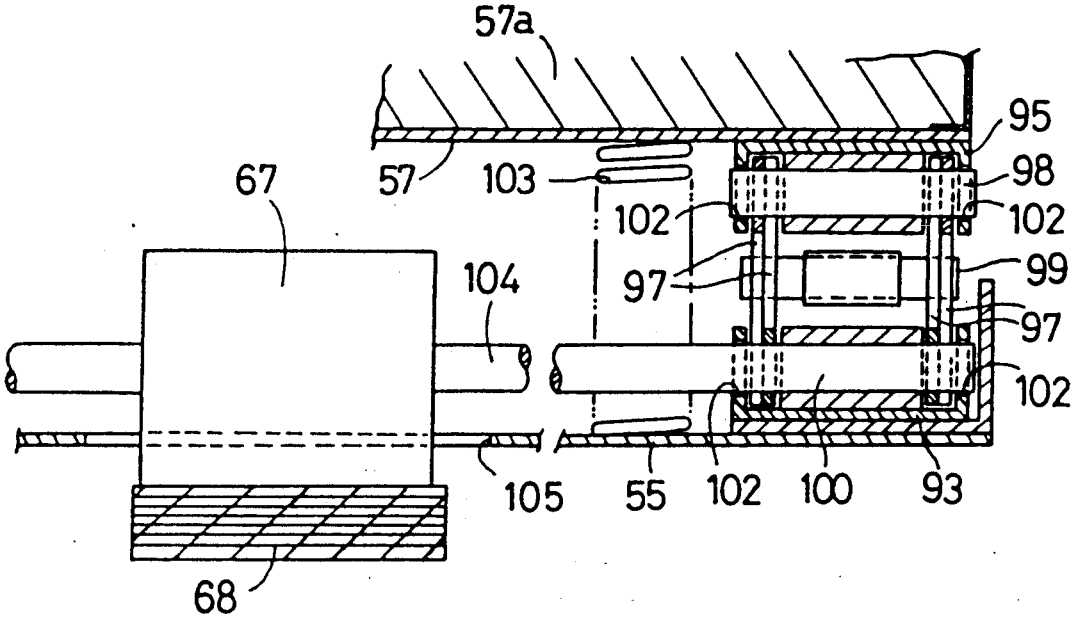
FIG. 22 is a sectional view taken on lines XXII—XXII in FIG. 20.
Figure 23:
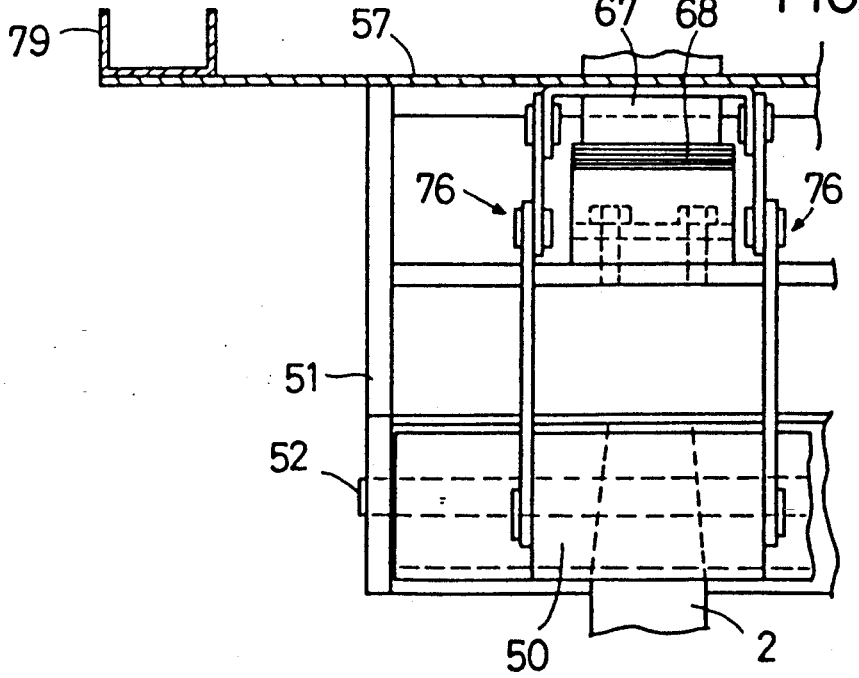
FIG. 23 is a sectional view taken on lines XXIII—XXIII in FIG. 20.

As better shown in FIGS. 21 and 22, the foremost lower pin 100 of the rear pantograph mechanism 101 is longitudinally extended to be commonly used for the rear lower channel members 93 on both sides of the seat base 55. Further, the foremost lower pin has an intermediate portion 104 for rotatably supporting a contact roller 67. The seat base has an opening 105 for enabling the contact roller 67 to come into rolling contact with the first tilting control plate spring 68. Indicated at 103 are weight responsive compression springs interposed between the seat base 55 and the seat plate 57.

In operation, when the weight of the sitter is applied to the seat B, the seat plate 57 is pressed against the weight responsive springs 103 toward the seat base 55, thereby causing the pantograph mechanisms 96, 101 to deform. As a result, the contact roller 67 advances relative to the tilting control spring 68, as indicated by phantom lines in FIG. 20. In this way, the spring constant of the tilting control spring is automatically adjusted depending on the weight of the user.

Figure 20:
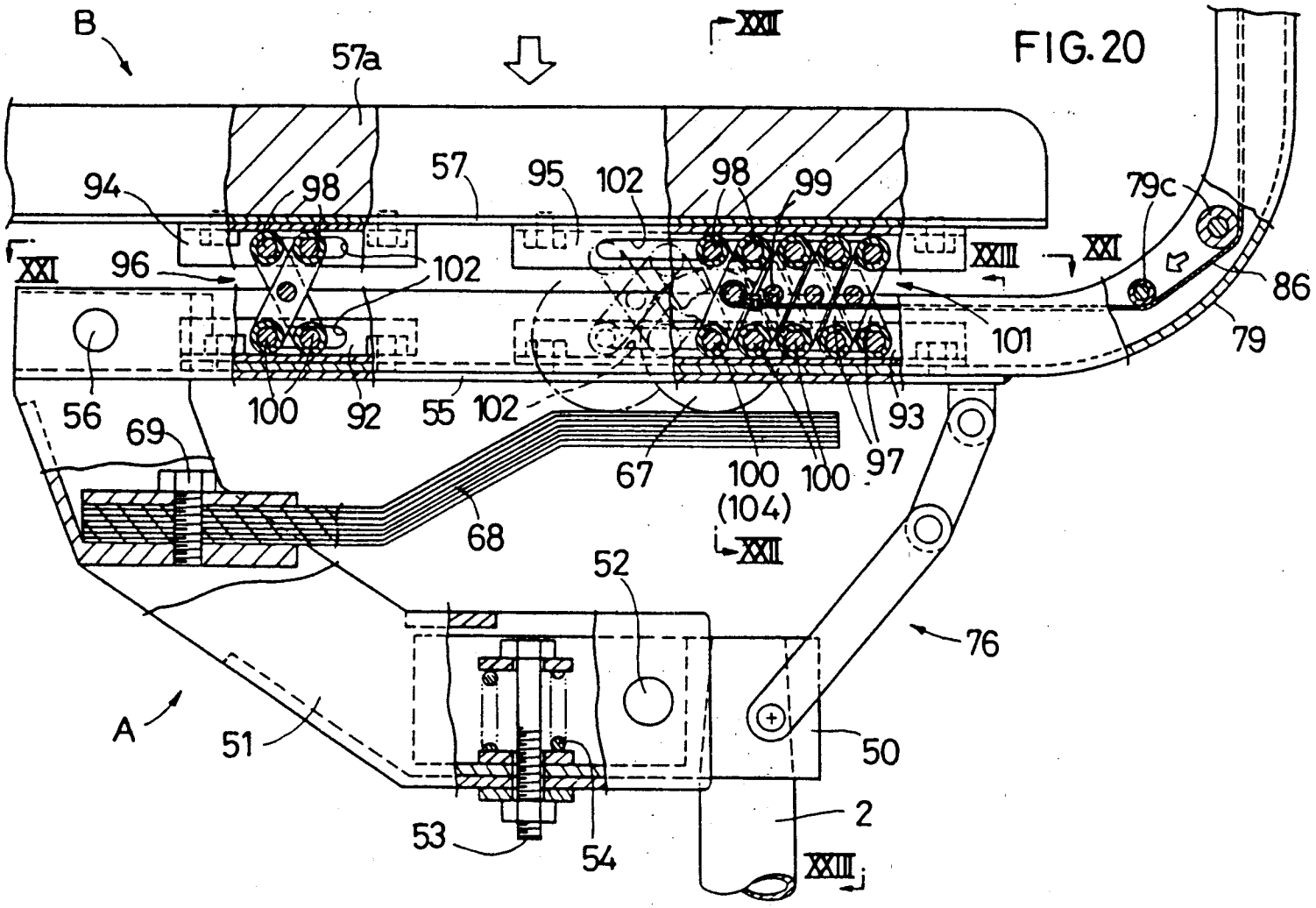
FIG. 20 is a side view, partially in section, of a rocking chair according to a sixth embodiment of the invention.

As clearly shown in FIGS. 20 and 21, the rocking chair according to the sixth embodiment includes a pair of pull bands 86 (only one shown) which are connected to the rear pantograph mechanism 101. Thus, the pull bands can be used for automatic spring adjustment with respect to tilting control for the chair back C in the same manner as shown in FIGS. 12 to 15.

Figure 24:
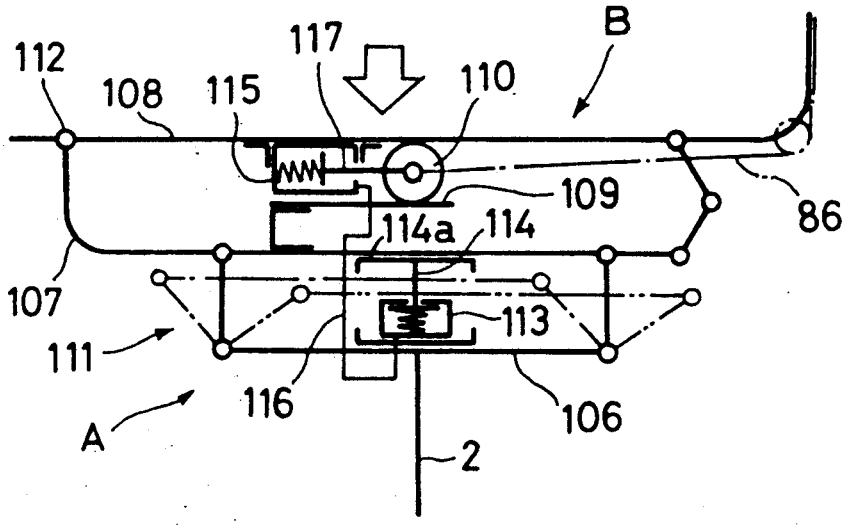
FIG. 24 is a schematic side view showing a rocking chair according to the seventh embodiment of the invention.

FIG. 24 schematically shows a seventh embodiment of the present invention wherein hydraulic cylinders are used for tilting control adjustment. More specifically, the rocking chair according to this embodiment comprises a support mechanism A, and a seat B supported by the support mechanism.

The support mechanism A includes a fixed frame 106 fixed to the upper end of a chair leg post 2, and a movable frame 107. Similarly to the first embodiment, the fixed and movable frames constitute a parallelogrammic linkage mechanism 111 in combination with front and rear links. Thus, the movable frame 107 is movable in the back-and-forth and up-and-down directions relative to the fixed frame 106.

The seat B includes a seat base 108 having its front end pivotally connected to the front end of the movable frame 107 by a shaft 112. Thus, the seat B is tiltable about the shaft.

A tilting control plate spring 109 is fixed at one end to the movable frame 107. The weight of the user is supported by the tilting control spring 109 via a contact roller 110.

A weight responsive hydraulic cylinder 113 is interposed between the fixed frame 106 and the movable frame 107. This cylinder has an oil chamber on the side of the piston away from the movable frame. The hydraulic cylinder further has a piston rod 114 which is upwardly spring-biased for supporting the movable frame. The upper end of the piston rod may be provided with a sliding member 114*a* to come into sliding contact with the movable frame. It is of course possible to replace the sliding member 114*a* by a contact roller.

An operating hydraulic cylinder 115 is mounted on the underside of the seat base 108 above the tilting control spring 109. The operating cylinder has a piston rod 117 which is spring-biased rearwardly of the chair. This piston rod rotatably supports the contact roller 110. The operating cylinder has an oil chamber on the side of the piston closer to the contact roller. The oil chamber of the operating cylinder is connected to the oil chamber of the weight responsive cylinder 113 through a hose 116.

In operation, the weight of the user causes the movable frame 107 to move toward the fixed frame 106, thereby depressing the piston rod 114 of the weight responsive cylinder 113. The working oil within the oil chamber of the weight responsive cylinder is expelled through the hose 116 to flow into the oil chamber of the operating cylinder 117. As a result, the contact roller 110 is moved forward relative to the tilting control spring 109 to increase the spring constant thereof. Obviously, the piston rod 114 of the weight responsive cylinder 113 is depressed to the degree substantially proportional to the weight of the sitter, so that the spring constant of the tilting control spring 109 is correspondingly increased.

As shown in FIG. 24, the piston rod 117 of the operating cylinder 115 may be connected to a pull band 86. Apparently, such a pull band can be utilized for tilting control adjustment with respect to the chair back (not shown).

Figure 25:
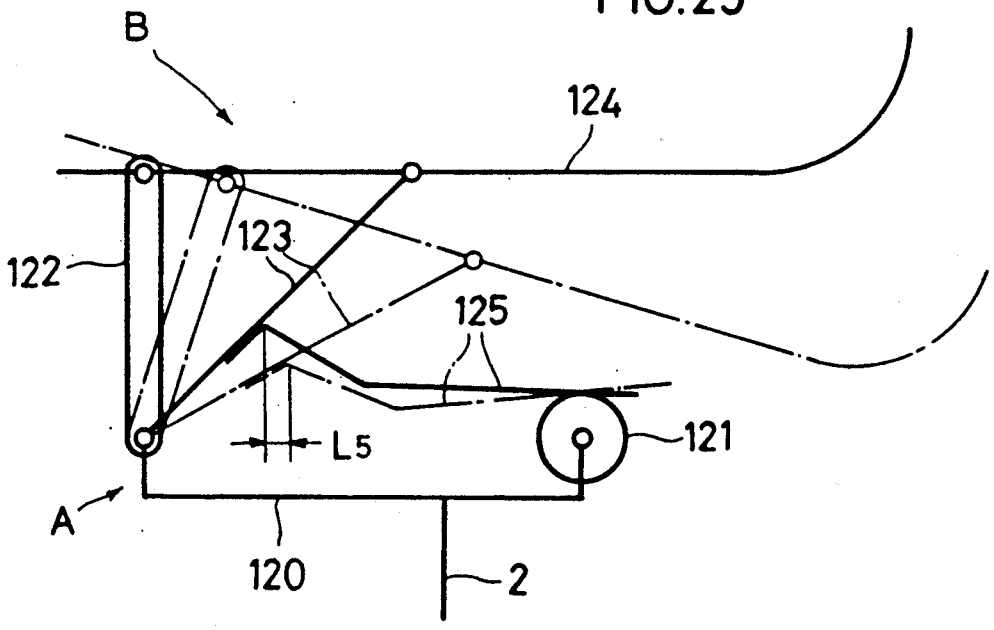
FIG. 25 is a schematic side view showing a rocking chair according to the eighth embodiment of the invention.

FIG. 25 schematically illustrates a rocking chair according to an eighth embodiment of the present invention. This rocking chair is much simpler than any of the foregoing embodiments, but yet effective for tilting control adjustment.

As illustrated, the rocking chair according to the eighth embodiment again comprises a support mechanism A, and a seat B supported by the support mechanism. The support mechanism includes a fixed frame 120 mounted to the upper end of a chair leg post 2. The fixed frame has a rear end rotatably supporting a contact roller 121. A pair of restraining links 122 (only one shown) have their lower ends pivotally connected to the front end of the fixed frame. Further, a pair of support links 123 (only one shown) have their lower ends pivotally connected to the front end of the fixed frame.

The seat B includes a seat base 123 having a front end pivotally connected to the upper end of each restraining link 122. Further, the seat base has an intermediate portion pivotally connected to the upper end of each support link 123.

A tilting control plate spring 125 is fixed at one end to the support links 123 in the same manner as shown in FIGS. 1 and 2. The plate spring has a free end resting on the contact roller 12.

In operation, when the weight of the user is applied to the seat B, the seat base 124 is pressed downward against the tilting control spring 125. Simultaneously with such downward movement of the seat base, the restraining links 122 and the support links 123 are pivoted downward, as indicated by phantom lines in FIG. 25. As a result, the tilting control spring 125 fixed to the support links 123 is displaced rearward relative to the fixed contact roller 121 by an amount L5. Thus, the spring constant of the tilting control spring is automatically adjusted (increased) because the degree of initial downward movement (tilting) of the seat base 124 is substantially proportional to the weight of the user.

The embodiment shown FIG. 25 positively utilizes the fact that the initial tilting of the seat B varies depending on the weight of the user, and such seat tilting causes the support links 123 to initially pivot to a variable degree. The pivotal movement of the support links 123 is in turn utilized to cause horizontal displacement of the tilting control spring 125 relative to the fixed contact roller 121.

Obviously, when the seat B is purposely tilted downward further than the initial tilting, a similar spring adjustment also occurs. This phenomenon is generally acceptable or rather preferable because the downward tilting must be stopped at some point, and such stoppage requires a stronger spring force.

The present invention being thus described, it is obvious that the same may be varied in many other ways. For instance, the plate-like tilting control spring or springs can be replaced by a rod-like spring or springs having a round or polygonal cross section. Further, a torsion spring can be equally used as the tilting control spring. Such variations are not to be regarded as a departure from the spirit and scope of the invention, and all such modifications as would be obvious to those skilled in the art are intended to be included within the scope of the following claims.

We claim:

1. A tilting control assembly for a chair, said chair comprising a support means mounted on a chair leg means, a chair seat carried by said support means, and a chair back arranged behind said seat, at least one of said seat and said back constituting a tiltable member; said tilting control assembly comprising:

a tilting control spring means for elastically supporting said tiltable member via a load applying means, said tilting control spring means being variable in spring constant; and an adjusting means which is automatically responsive to the weight applied to said seat for causing relative displacement between said tilting control spring means and said load applying means in a manner such that the spring constant of said tilting control spring means increases as said weight increases, wherein said tilting control spring means comprises at least one elongate spring, said load applying means comprises at least one contact member held in contact with said elongate spring, and said adjusting means causes relative movement between said elongate member and said contact member longitudinally of said elongate spring.

2. The tilting control assembly as defined in claim 1, wherein said elongate spring is in the form of a plate spring.

3. The tilting control assembly as defined in claim 1, wherein said elongate spring is supported only at one end.

4. The tilting control assembly as defined in claim 3, wherein said elongate spring is made to have second moment of area progressively decreasing toward the other end of said elongate spring.

5. The tilting control assembly as defined in claim 1, wherein said elongate spring is supported at both ends.

6. The tilting control assembly as defined in claim 1, wherein said contact member is in the form of a contact roller which comes into rolling contact with said elongate spring.

7. The tilting control assembly as defined in claim 1, wherein said contact member comes into sliding contact with said elongate spring.

8. The tilting control assembly as defined in claim 1, wherein said adjusting means causes said contact member to move relative to said elongate spring longitudinally thereof.

9. The tilting control assembly as defined in claim 1, wherein said adjusting means causes said elongate spring relative to said contact member longitudinally of said elongate spring.

10. The tilting control assembly as defined in claim 1, wherein said seat is movable downward when said weight is applied thereto, and said adjusting means comprises a converting means for converting the downward movement of said seat into relative movement between said elongate spring and said contact member longitudinally of said elongate spring.

11. The tilting control assembly as defined in claim 10, wherein said converting means comprises a parallelogrammic linkage mechanism which is deformable against a weight responsive spring means when said weight is applied to said seat, the deformation of said parallelogrammic linkage mechanism causing relative movement between said elongate spring and said contact member longitudinally of said elongate spring.

12. The tilting control assembly as defined in claim 10, wherein said converting means comprises a pantograph linkage mechanism which is deformable against a weight responsive spring means when said weight is applied to said seat, the deformation of said pantograph linkage mechanism causing relative movement between said elongate spring and said contact member longitudinally of said elongate spring.

13. The tilting control assembly as defined in claim 10, wherein said support means comprises a fixed frame mounted to said chair leg means, and a movable frame arranged above said fixed frame, said movable frame being movable toward said fixed frame against a weight responsive spring means when said weight is applied to said seat; and said converting means functions to convert the movement of said movable frame toward said fixed frame into relative movement between said elongate spring and said contact member longitudinally of said elongate spring.

14. The tilting control assembly as defined in claim 10, wherein said converting means comprises at least one weight responsive hydraulic cylinder having an oil chamber whose volume is reduced when said weight is applied to said seat, and at least one operating hydraulic cylinder having an oil chamber connected to said oil chamber of said weight responsive cylinder, said oil chamber of said operating cylinder being variable in volume to cause relative movement between said elongate spring and said contact member longitudinally of said elongate spring.

15. The tilting control assembly as defined in claim 10, wherein said support means comprises a fixed frame mounted to said chair leg means, and said converting means comprises at least one support link pivotally connected at one end to said fixed frame and at the other end to said seat, the pivotal movement of said support link causing relative movement between said elongate spring and said contact member longitudinally of said elongate spring.

16. A tilting control assembly for a chair, said chair comprising a support means mounted on a chair leg means, a chair seat tiltably carried by said support means, and a chair back tiltably arranged behind said seat; said tilting control assembly comprising:

a first tilting control spring means for elastically supporting said seat via a first load applying means, said first tilting control spring means being variable in spring constant;

a second tilting control spring means for elastically supporting said back via a second load applying means, said second tilting control spring means being variable in spring constant; and an adjusting means which is automatically responsive to the weight applied to said seat for causing relative displacement between said first tilting control spring means and said first load applying means as well as between said second tilting control spring means and said second load applying means in a manner such that the spring constant of said first and second tilting control spring means increases as said weight increases.

17. The tilting control assembly as defined in claim 16, wherein each of said first and second tilting control spring means comprises at least one elongate spring, each of said first and second load applying means comprises at least one contact member held in contact with said elongate spring, and said adjusting means causes relative movement between said elongate member and said contact member longitudinally of said elongate spring.

18. The tilting control assembly as defined in claim 17, wherein said adjusting means comprises a pull means which causes relative movement between the second tilting control elongate spring and the the second contact member longitudinally of said second tilting control elongate spring in response to relative movement between the first tilting control elongate spring and the first contact member longitudinally of said first tilting control elongate spring.

19. The tilting control assembly as defined in claim 18, wherein said pull means comprises at least one pull band.

* * * * *